United States Patent [19]

Haczewski, Jr.

[11] Patent Number: 4,959,819

[45] Date of Patent: Sep. 25, 1990

[54] REGENERATING POWER UNIT

[76] Inventor: Joseph J. Haczewski, Jr., 1424 Poquoson Ave., Poquoson, Va. 23662

[21] Appl. No.: 381,273

[22] Filed: Jul. 18, 1989

[51] Int. Cl.[5] ..... G04F 1/04; A63H 29/17

[52] U.S. Cl. ..... 368/93; 446/166

[58] Field of Search ..... 368/93, 91, 94, 95; 446/166, 167, 168, 169

[56] References Cited

U.S. PATENT DOCUMENTS

| | | | |
|---|---|---|---|
| 328,398 | 10/1885 | Freeman | 446/166 |
| 798,883 | 9/1905 | Dedrick | 446/166 |
| 1,055,266 | 3/1913 | Gibson | 446/166 |
| 1,181,657 | 5/1916 | Fox | 446/167 |
| 2,573,625 | 10/1951 | Swart | 446/166 |

FOREIGN PATENT DOCUMENTS

| | | | |
|---|---|---|---|
| 896923 | 11/1953 | Fed. Rep. of Germany | 446/166 |
| 814250 | 6/1937 | France | 446/166 |
| 987825 | 8/1951 | France | 446/166 |
| 1272181 | 8/1961 | France | 446/166 |
| 1349766 | 11/1987 | U.S.S.R. | 446/166 |
| 846171 | 3/1961 | United Kingdom | 446/166 |

*Primary Examiner*—Bernard Roskoski

*Attorney, Agent, or Firm*—Wallace J. Nelson

[57] ABSTRACT

This invention relates to a regenerating power unit employing a flowable medium to drive a rotatable wheel and attached axle with various attachments being utilized on the rotating axle for educational and/or amusement purposes. The power unit 10 is provided with a front and back wall 17,18 either or both of which may be transparent, and a pair of flowable medium reservoirs in fluid communication with a chambered wheel 22. A suitable adjustment valve 48 (FIG. 7) and 50 (FIG. 8) controls the rate of flow of flowable medium 39. When one medium reservoir is emptied, the power unit is rotated 180° and the power unit may resume operation. A support stand 34 (FIGS. 2, 5 and 6) is employed when it is desired to permit rotation of power unit 10 without lifting thereof. Various educational and/or amusement accessories for power unit 10 are illustrated in FIGS. 9–18.

14 Claims, 4 Drawing Sheets

REGENERATING POWER UNIT

FIELD OF THE INVENTION

This invention relates generally to timer mechanisms and relates in particularly to a fluid medium timer that serves as a regenerating power unit for visual display of movable scenery, objects, and the like, to serve as an educational and/or amusement device.

BACKGROUND OF THE INVENTION

Timing devices employing sand and other flowable media in hourglass type timers are well known in the art. Most of these devices involve permitting the sand or other fluid medium to flow through a controlled size orifice with it being known that a fixed time period is required for all of the sand to be expended, after which time the device may be rotated 180° and the process repeated. Few, if any of these known timers may be adjusted to vary the timing operation thereof and none are known that employ motion responsive units to provide a separate aesthetic display apparatus, along with the timing operation, for educational and/or amusement purposes.

SUMMARY OF THE INVENTION

It is therefore an object of the present invention to provide an improved fluid medium actuated timer that may be adjusted for various time settings.

Another object of the present invention is a flowable medium timer device that actuates a motion unit during the timing operation.

A further object of the present invention is a regenerating power unit employing a flowable medium and useful for educational and/or amusement purposes.

An additional object of the present invention is a novel, flowable medium, timer device for rotating movable links, display assemblies, and the like.

Another object of the present invention is a regenerating power unit employing a flowable medium and actuating an audible unit such as a bell or chimes at periodic intervals during the timing operation.

A further object of the present invention is a novel support stand for a timer unit that assists in rotation of the timer unit for resetting thereof.

According to the present invention, the foregoing and additional objects are attained by providing a box housing having a pair of end wall members, a pair of side wall members and a front and back wall member attached, in flush or recessed spaced relationship relative to the ends and sides of the box housing. At least one of the front and back wall members is formed of a transparent material. A rotatable axle member is perpendicularly disposed relative to and within the front and back wall members with a length of the axle extending through at least one of the front and back wall members. A hub, having an integral wheel assembly, is secured for rotation with the axle and is disposed between the spaced front and back members. The wheel is formed of a plurality of tangential vanes extending from the hub and covered with a pair of wheel covers, at least one of which is transparent, to form a plurality of substantially triangular, open end chambers therein. The triangular open end chambers are tangentially disposed relative to the hub axis such that an open chamber is always facing upward, or substantially perpendicular to a horizontal plane taken through the hub axis, at essentially the one o'clock position of the wheel and one open chamber facing downward at essentially the seven o'clock position of the wheel.

A pair of diagonal supports, each having one end thereof fixedly connected to one of the side wall members and the other end thereof unattached and spaced from the opposite side wall member, form a pair of open end reservoirs on opposite sides of the wheel. A quantity of flowable medium, liquid, granular, or the like, is disposed within one of the reservoirs. The flowable medium flows from the reservoir, via an adjustable aperture provided within the diagonal support, into one or more open end chambers of the wheel located at substantially the one o'clock station of the wheel. The gravitational force of the flowable medium received in the wheel causes rotation of the wheel, and its attached axle. As the wheel rotates, the chambers receiving the flowable medium are emptied while other chambers are rotated into position to receive the flowable medium. This wheel rotation continues until the supply of flowable medium is exhausted from the open end reservoir, whereupon the box housing is rotated 180° to capture the expended flowable medium in the other open end reservoir and subsequent flow of the flowable medium through the aperture of this reservoir causes the wheel to resume rotation. The box housing may be retained with a support stand to assist in rotation thereof or it may be free-standing. Visual and/or audible display apparatus may be attached to or positioned on the exposed end(s) of the rotatable axle and utilized for education and/or amusement purposes.

BRIEF DESCRIPTION OF THE DRAWINGS

A more complete appreciation of the invention and many of the attendant advantages thereof will be readily apparent as the same becomes better understood with reference to the following detailed description when considered in connection with the accompanying drawings wherein.

DETAILED DESCRIPTION OF THE INVENTION

Figure 1:
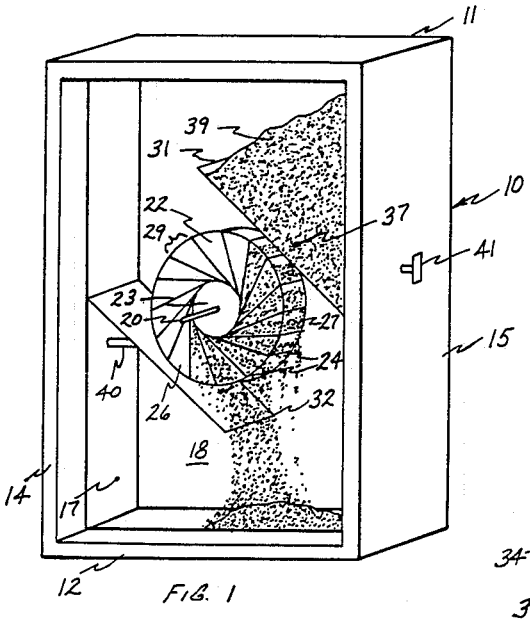
FIG. 1 is perspective view of the regenerating power unit of the present invention.
Figure 2:
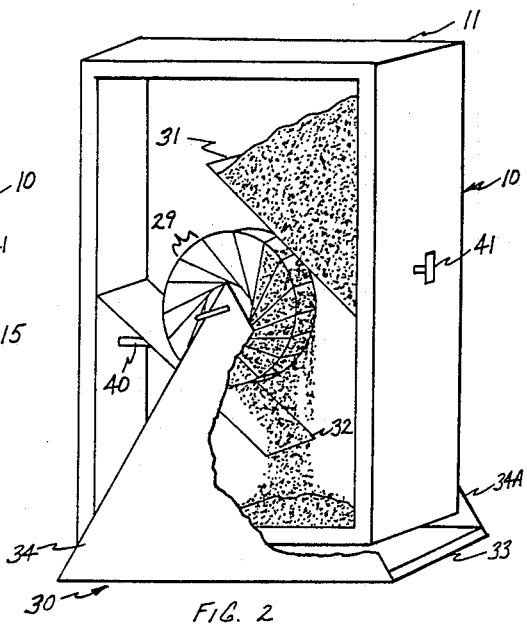
FIG. 2 is a view similar to FIG. 1 and illustrating the optional support stand employed with the regenerating power unit shown in FIG. 1.
Figure 5:
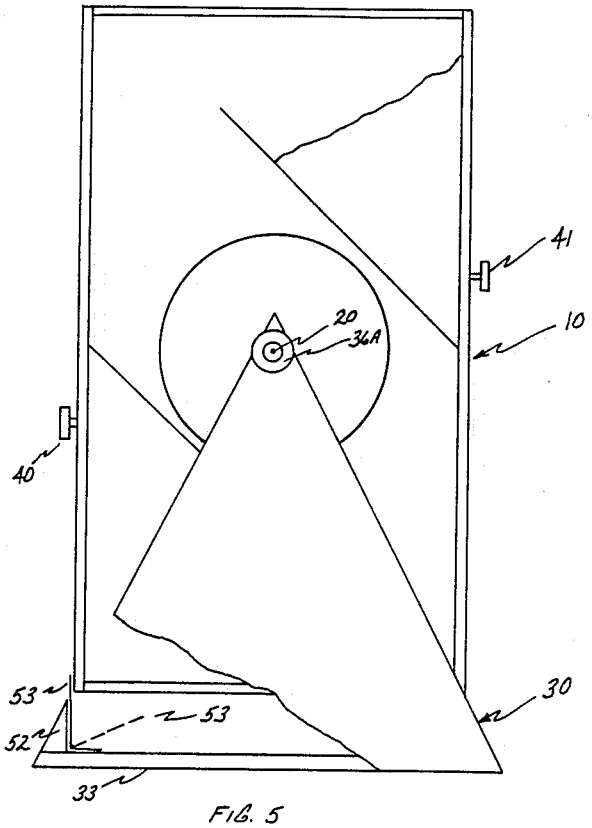
FIG. 5 is a front view of the regenerating power unit and support stand therefor as shown in FIG. 2 with parts broken away.

Referring now to the drawings, and more particularly to FIGS. 1 and 2, the regenerating power unit of the present invention is shown and generally designated by reference numeral 10. Power unit 10 includes a box housing having a pair of end wall members 11,12, a pair of side wall members 14,15 and a front and back wall member, designated respectively by reference numerals 17 and 18. Front wall and back wall 18 are attached to and contained in spaced relationship within the pair of end walls 11,12 and the pair of side walls 14,15. Alternatively, the front and back walls 17,18 may be disposed in spaced relationship abutting the end and side walls, as illustrated in the embodiments of FIGS. 2 and 5.

A rotatable axle member 20 is perpendicularly disposed relative to front wall 17 and back wall 18 and is of adequate length to leave a portion of the length thereof extending through both front wall 17 and back wall 18. A wheel 22 is disposed between and adjacent front wall 17 and back wall 18 and provided with a hub portion 23 fixed to axle 20 for rotation therewith. Wheel 22 includes a plurality of vanes 24 tangentially extending from the hub portion thereof to a distance spaced from the hub portion. A circular wheel cover is provided on each side of wheel 22, as designated by reference numerals 26,27. At least one of wheel covers 26,27 is made of a transparent material. Wheel covers 26,27 are in abutting sealed contact with vanes 24 to form a plurality of open end, substantially triangular, chambers therewith and as designated by reference numeral 29. The angular relationship of vanes 24 relative to the axis of wheel 22 (axle 20) is such that an open chamber 29 is always facing upward or substantially perpendicularly to a horizontal plane taken along the axis of axle 20 at essentially the one o'clock position on wheel 22, and one chamber 29 is always perpendicularly disposed, relative to a horizontal plane taken along the axis of axle 20, and facing downward at substantially the seven o'clock position of wheel 22. In the specific embodiment illustrated in FIG. 1 sixteen vanes 24 are provided on wheel 22 to form sixteen chambers 29 with each chamber, minus the thickness of the vanes, occupying substantially twenty-two and one-half degrees of circular wheel 22.

A pair of elongated diagonal supports 31,32 are secured in contacting relationship with, and between, front wall 17 and back wall 18. Diagonal support 31 has one end attached to side wall 15 with the other end thereof unattached and spaced from side wall 14. Diagonal support 32 has one end thereof attached to side wall 14 with the other end thereof unattached and spaced from side wall 15. Diagonal supports 31,32, and the attached wall areas form a pair of open, substantially triangular reservoirs (not designated) on opposite sides of wheel 22. Diagonal supports 31,32 are each provided with an aperture therethrough, one of which is illustrated and designated by reference numeral 37. A quantity of flowable medium 39 is shown supported by diagonal support 31 and is adapted to flow through aperture 37 therein to enter a chamber 29 of wheel 22. A pair of adjustable valves 40,41 are provided through respective side walls 14,15 to control the rate flowable medium 39 exits through respective apertures 37, and the one not shown in diagonal support 32, as will be further explained hereinafter.

Referring now more particularly to FIG. 2 a support stand for regenerating power unit 10 is shown and designated generally by reference numeral 30. Stand 30 includes a base 33 and a pair of parallel, spaced, triangular sides 34,34*a* attached to and extending vertically from the respective sides of base 33. A transverse through opening is provided at substantially the apex of each side 4,34*a* and serves to receive axle 20 of power unit 10 for rotative support thereof, as will be further explained hereinafter.

Figure 2A:
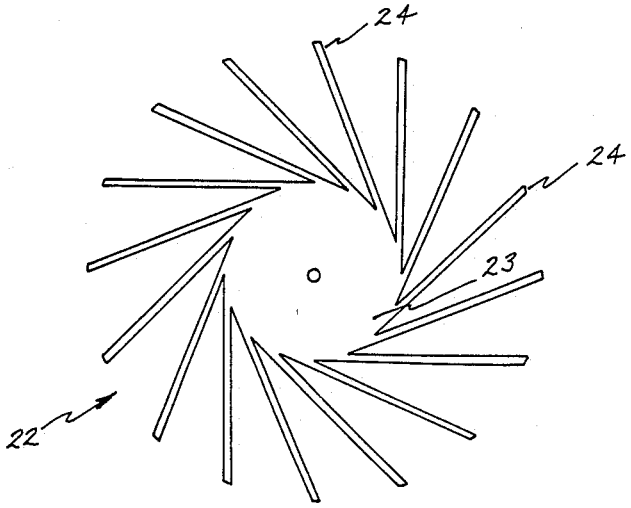
FIG. 2*a* is a front plan view of the wheel employed in the power units shown in FIGS. 1 and 2 prior to installation of the wheel covers thereon.

Referring to FIG. 2*a*, the tangential relationship of vanes 24 extending from hub 23 of wheel 22 is more clearly illustrated. As shown therein, one side of each pair of adjacent vanes 24 terminate at a point on hub 23 to thereby form an elongated, substantially triangular, spacing between adjacent vanes. When wheel covers 26,27 are installed on wheels 22, as shown in FIGS. 1 and 2, these elongated, substantially triangular spaced areas form open chambers 29.

Figure 3:
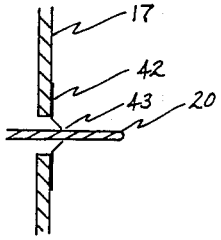
FIG. 3 is a part sectional view illustrating the bearing seal for the rotatable axle extending through the front and/or back wall of the regenerating power unit shown in FIG. 1.

Referring now to FIG. 3, an exemplary bearing element 42 is adhesively bonded to the surface of an opening in front wall 17 to serve as the supporting structure for rotatable axle 20 extending therethrough. Bearing element 42 is formed of brass or other suitable material and provided with a knife-edge surface opening 43 for receiving rotatable axle 20 therein. This knife-edge surface permits free rotation of rotatable axle 20 while eliminating or minimizing any possible leakage of flowable medium 39 through front wall 17 during manual rotation of unit 10.

Figure 4:
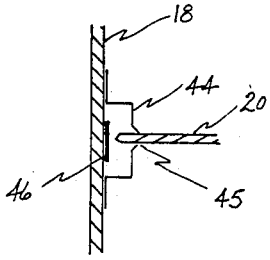
FIG. 4 is a view similar to FIG. 3 illustrating a modified bearing support for a rotatable axle end that does not extend through the wall.

Referring to FIG. 4, an alternate embodiment for the bearing support is shown as utilized with alternate embodiments of the invention wherein rotatable axle 20 is designed to have only one or neither end thereof extending through front wall 17 or rear wall 18. As shown therein, a hat-shaped bearing block 44 is adhesively attached, for example, to rear wall 18 and provided with an opening 45 therein to rotatably receive axle 20. A rub plate 46 is also adhesively attached to the inside surface of wall 18 to prevent rotating axle 20 from coming in contact with and possibly damaging the wall surface during rotation. Bearing block 44 and rub plate 46 are also formed of brass or other suitable material, with bearing block 44 being provided with a knife-edge surface for the axle receiving opening 45 therein, as described for bearing element 42 of FIG. 3.

Figure 6:
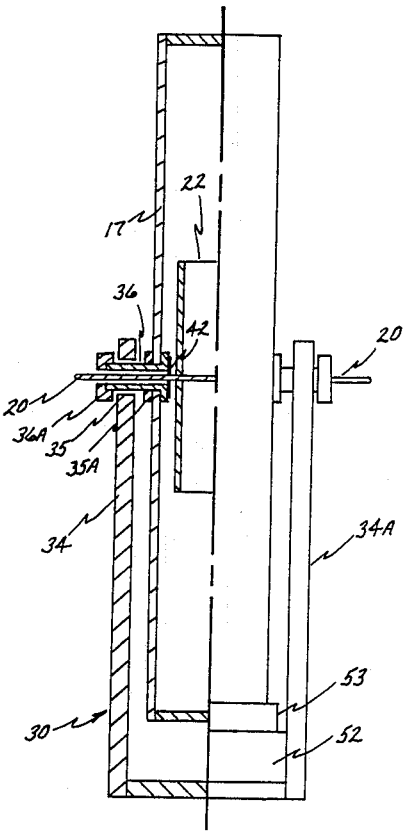
FIG. 6 is a part sectional side view of the invention as shown in FIGS. 2 and 5 and illustrating one bearing support structure therefor.

Referring now to FIGS. 5 and 6, the details of support stand 30 will now be described. As discussed hereinabove, triangular sides 34,34*a* are each provided with a transverse through opening at substantially the apex thereof to receive axle 20. Opening 35 for triangular side 34 is illustrated in FIG. 6. An elongated tubular bearing 36, having a circular top (not designated), is disposed inside of front wall member 17 to support bearing 42. Tubular bearing 36 extends through wall member 17 and triangular side 34. An annular spacer retainer 35*a* is provided around tubular bearing 36 and between triangular side 34 and front wall member 17. An end cap 36*a* is attached to tubular bearing 36 for retention thereof within opening 35 of triangular side 34. The through opening in tubular bearing 36 is of adequate diameter to permit axle 20 to freely rotate therein. The bearing structure for the opposite end of axle 20 extending through triangular side 34*a* is identical to that described for side 34 and is not further described herein in the interest of brevity. Axle 20 is slidably adjustable through bearings 36 to extend or reduce the length extending from either the front or back members. Support stand 30 maintains power unit 10 vertically spaced from base 33, as illustrated. Power unit 10 is rotated counter-clockwise about axle 20 for resetting or repositioning the flowable material 39 once all of material 39 has flowed to the bottom of unit 10. Support stand 30 permits this rotation of power unit 10 without lifting of the unit or without displacement of axle 20 and with a minimum of effort. A bracket 52, having a triangular cross-sectional area, is attached to one end of base 33 of stand 30 and extends across the spacing between vertical sides 34,34*a*. A flexible detent 53, having an L-shaped cross-sectional area, is disposed against bracket 52. The short or horizontal leg of the L-shaped flexible detent is secured to base 33 and the long or vertical leg of the flexible detent rests against and extends slightly above the height of bracket 52, as shown more clearly in FIG. 5. The height of the long or vertical leg of flexible detent 53 extends slightly beyond the bottom of power unit 10 when power unit 10 is in a vertical position relative to horizontal base 33. Thus, upon rotation of power unit 10 counter-clockwise, as shown in FIG. 5, the top left corner of unit 10 will contact detent 53 and cause a bending or flexible displacement thereof to the position indicated by the dotted line. When the upper right corner (again as shown in FIG. 5) is rotated past the bent or flexed detent, the detent snaps back into the position shown to prevent clockwise movement of power unit 10. Without this feature, power unit 10 would tend to rotate clockwise under the influence of the weight of flowable medium 39 flowing into the opposite corner thereof. Rigid but flexible detents suitable for use in practice of the invention were constructed of spring steel, however, polyvinyl chloride and various other plastic materials are also suitable for this purpose.

Figure 7:
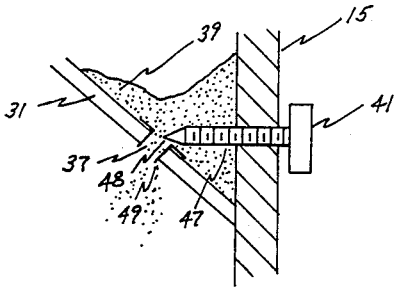
FIG. 7 is a sectional view of a needle valve adjustment mechanism employed to control the rate of flow of the flowable medium used with the regenerating power unit shown in FIGS. 1 and 2.

Referring now to FIG. 7, the details of needle valve 41 will now be described. As shown therein, needle valve 41 is provided with an elongated portion 47 threadingly extending through side wall 15 and having a tapered pointed tip 48. Pointed tip 48 is adapted to be received within a grommet or eyelet 49 lining aperture 37 in diagonal support 31. Rotation of needle valve 41 thus controls the location of pointed tip 48, relative to opening 37, to control the rate of flowable medium 39 passing therethrough. This flow rate is adjustable from zero, when pointed end tip 48 is completely received in eyelet 49, to fully open position when pointed end tip 48 is completely moved out of the flow path in aperture 37. Needle valve 40 is identical to valve 41 and is not further described herein in the interest of brevity.

Figure 8:
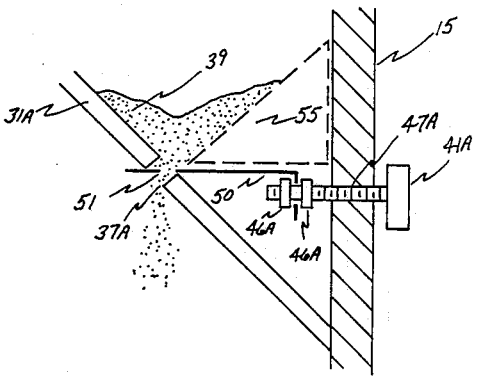
FIG. 8 is a view similar to FIG. 7 illustrating a modified flow valve and reservoir assembly for use in the present invention.

Referring now to FIG. 8, a modified flow valve assembly for controlling the rate of flowable material 39 is shown. In this embodiment, valve 41*a* includes an elongated threaded shaft 47*a* threadingly received through side wall member 15. A pair of spaced nuts 46*a* are disposed on the end of shaft 47*a* in spaced relationship to retain a gate valve closure 50 in connection with and movable by shaft 47*a*. Gate valve 50 has a first portion parallel with threaded shaft 47*a* and a second portion at one end thereof perpendicular thereto and provided with an opening received by shaft 47*a*. The other end of gate valve 50 is provided with a slotted opening 51 therethrough. Gate valve 50 extends through a slotted opening 37*a* provided in diagonal support 31*a* with opening and closure of slotted opening 37*a* being controlled by the relative position of gate valve and its slotted opening 51. A triangular spacer or barrier element 55 is secured to side wall 15 above gate valve 50. Spacer 55 serves to prevent flowable material 39 from impeding the movement of gate valve 50 by retaining the flowable medium 39 above slotted opening 37*a*. This structure serves to optimize utilization of essentially all of the flowable medium. The opening in valve gate 50 received by threaded section 47*a* is large enough to permit free rotation of section 47*a* therein but small enough to ensure retention of valve gate 50 by nuts 46*a*. Thus, upon rotation of shaft 47*a*, valve gate 50 is slidably moved to change the position of slotted opening 51 therein relative to slotted opening 37*a* in diagonal support 31*a* and thereby control the flow of flowable medium 39 therethrough.

Figure 9:
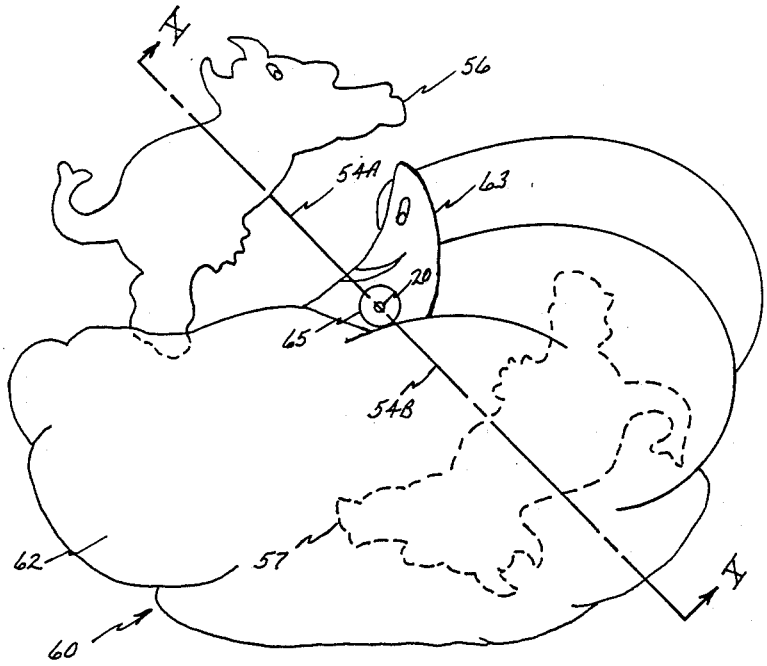
FIG. 9 is a schematic view of one educational and/or amusement mechanism employed with the regenerating power unit shown in FIG. 1.
Figure 10:
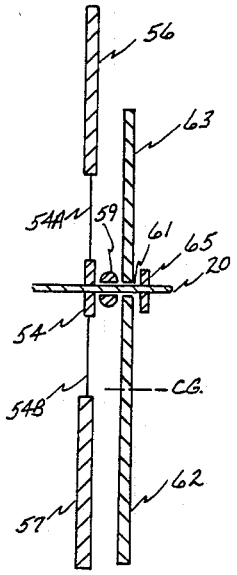
FIG. 10 is a sectional view taken along line X—X of FIG. 9.

Referring now to FIGS. 9 and 10, the details of one educational and/or amusement accessory employed with the self-generating power unit 10 will now be described. As shown therein, a spoke hub 54 is force-fitted onto the portion of rotatable axle 20 that extends from front wall 17. A pair of diametrically opposed spokes 54*a*,54*b* are attached at one end to, and extend radially from, spoke hub 54 with an animal figurine being attached to the opposite ends thereof, as designated, respectively, by reference numerals 56,57. Animal figurines 56,57 are designed to simulate cows. A bead spacer element 59 is slidably positioned on rotating axle 20 adjacent to fixed spoke hub 54. A one-piece scenery display 60, having an enlarged eyelet 61 therein, is slidably positioned onto rotating axle 20 adjacent bead spacer element 59. One portion of the scenery display 60 is painted to simulate clouds, as designated by reference numeral 62, while the other portion of the scenery display, designated by reference numeral 63, simulates the moon. An annular retainer 65 is frictionally secured to rotatable axle 20 adjacent scenery display 60 for retention thereof on axle 20. Scenery display 60 is provided with a center of gravity (designated by the letters "c.g.") at substantially the midpoint of cloud portion 62 to retain the cloud cover beneath rotating axle 20 and the moon portion 63 above axle 20, regardless of the orientation of regenerating power unit 10.

The operation of this educational and amusement accessory is believed apparent. As wheel 22 rotates due to the flow of flowable medium 39 received therein, spoke hub 54 and the attached cow figurines 56,57 will rotate, while display scenery showing clouds 62 and moon 63 remain stationery to give the appearance of the cow figurines jumping over the moon. While one cow 56 is "jumping", the other cow figurine 57 is obscured from view by the cloud cover. When the fluid medium supply is exhausted in one reservoir, the unit 10 is rotated 180° and the cows resume their movement, with the center of gravity of the scenery display causing self-righting thereof, or retention of the scenery in its position as box housing power unit 10 is rotated 180°. Instead of two cows, additional spokes could be added to spoke hub 54 with each spoke having a cow figurine thereon. Also, one of the spokes and attached cow shown in the illustrated embodiment could be eliminated and only one cow figurine employed in the operation of this embodiment of the invention.

Figure 11:
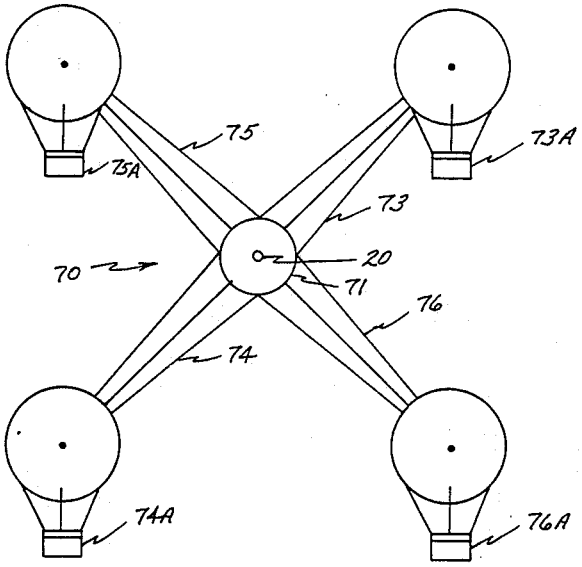
FIG. 11 is a schematic illustration of a miniature ferris wheel structure for use with the regenerating power unit of FIG. 1.

Referring now to FIG. 11, another educational and/or amusement accessory that may be used with regenerating power unit 10 is a miniature ferris wheel, designated generally by reference numeral 70 and retained on axle 20 by integral spoke hub 71. Ferris wheel 70 includes spoke hub 71 having two pair of diametrically opposed spokes 73,74 and 75,76 attached at one end thereof to, and extending radially from, hub spoke hub 71. The other end of each spoke 73,74,75 and 76 rotatably supports a self-righting simulated ferris wheel seat structure, as designated respectively by reference numerals **73*a*,74*a*,75*a* and 76*a*. Each simulated ferris wheel seat structure is provided with a center of gravity beneath the attachment thereof to the respective spokes to maintain self-righting of the simulated seats as the spokes turn with spoke hub 71**. Although the illustrated embodiment shows four spokes and attached simulated seats, obviously this number may be increased or decreased without changing the scope of the invention.

Figure 12:
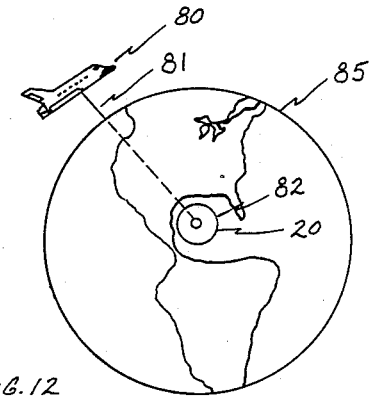
FIG. 12 is schematic view of a miniature space shuttle vehicle in Earth orbit and employed as an educational and/or amusement mechanism with the regenerating power unit shown in FIG. 1.

Referring now to FIG. 12, a simulated space shuttle vehicle 80 is illustrated and attached to a spoke 81 leading to a spoke hub (not shown) force fitted onto axle 20 for rotation therewith. A scenery display in the form of a disc simulating the Earth and designated by reference numeral 85, is retained on axle 20 via a retainer 82. Disc 85 is provided with an oversized off-centered opening therein for relative rotation about axle 20 as it rotates. The center of gravity of Earth disc 85 is below axle 20 in the illustration to thereby ensure that the relative position of the continents shown on the display are maintained when power unit 10 is rotated or reset. The off-center connection of disc 85 causes simulated shuttle 80 to vary in distance from the disk and thereby give the appearance of an elliptical orbit path. Thus, space shuttle simulator vehicle 80 is visible throughout its orbital flight about Earth with the attached spoke 81 thereof being substantially obscured from view by the Earth disc 85.

Figure 13:
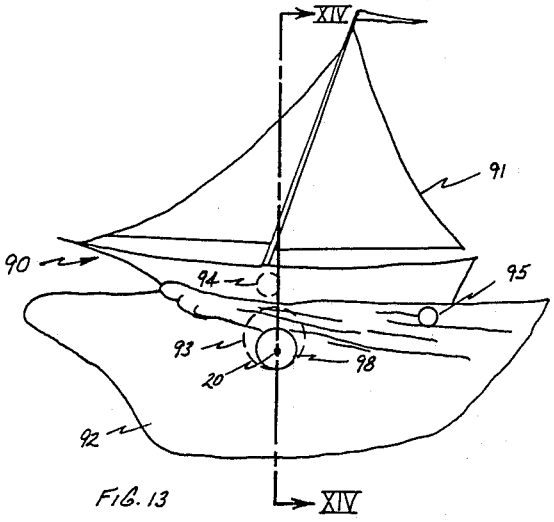
FIG. 13 is a schematic view of a simulated sail boat with motion thereof produced, by the regenerating power unit of FIG. 1.
Figure 14:
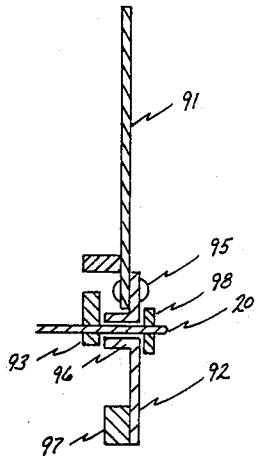
FIG. 14 is a sectional view taken along line XIV—XIV of FIG. 13.

Referring now to FIGS. 13–14, a simulated sail boat educational and amusement accessory for regenerating power unit 10, generally designated by reference numeral 90, will now be described. Simulated sail boat accessory 90 includes a miniature boat 91, that appears to be moving or sailing on a body of simulated water, designated by reference numeral 92. A rotatable disc 93, having an off-center opening therein is secured onto, and for rotation therewith, the segment of rotatable axle 20 extending through a wall 17 of self generating power unit 10. Rotatable disc 93 serves as a cam during rotation and is in contact with a rotatable cam follower disc 94. Cam follower disc 94 is linked to miniature boat 91 which is pivotally attached to simulated water body 92 at pivot point connection 95. As off-center disc 93 rotates with axle 20, cam follower disc 94 moves vertically relative thereto with attached boat 91 pivoting about connection 95 to give an appearance of boat 91 bobbing on the body of simulated water 92. The simulated water 92 is provided with a bushing 96 having an enlarged opening for receiving axle 20 therethrough to permit axle 20 to freely rotate therein. A weight 97 is provided on simulated water body 92 to maintain the boat 91 and water body 92 in self-righting position when power unit 10 is rotated for resetting. A frictional fit retainer ring 98 maintains simulated sail boat accessory 90 in position on axle 20.

In operation, as rotatable axle 20 rotates to turn cam disc 93, cam follower disc 94 is moved vertically to cause simulated boat 91 to pivot about connection 95, and undergo a bobbing or rocking motion to give the appearance of boat 91 sailing on a body of water. After the flowable medium is expended from one triangular reservoir, power unit 10 is rotated 180° . As power unit 10 is rotated 180° miniature boat 91 and cam follower 94 maintain their position along with the attached self-righting simulated water body 92. The resumption of flow of flowable medium 39 from the other reservoir causes simulated boat 91 to resume its pivoted movement and simulated sailing motion.

Figure 15:
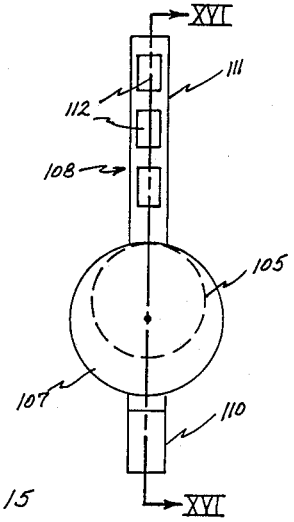
FIG. 15 is a schematic illustration of another educational and/or amusement mechanism for use with the regenerating power unit shown in FIG. 1.
Figure 16:
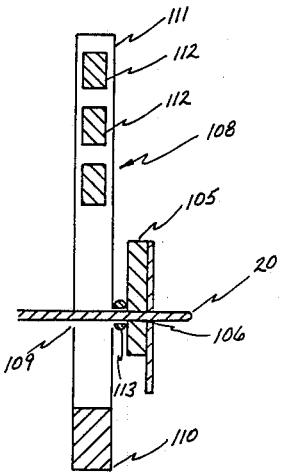
FIG. 16 is a sectional view taken along line XVI—XVI of FIG. 15.

Referring now to FIGS. 15 and 16, another educational and amusement accessory for use with power unit 10 is shown. As shown therein a magnetic disc 105 is fixedly attached to, and rotatable with, rotatable axle 20 via an off-center opening 106. A second disc 107 is secured to off-center disc 105 for rotation therewith to obscure from view the off-center relationship of disc 105. A self-righting assembly 108 is also disposed on axle 20 via an enlarged opening 109 therein. Assembly 108 includes a depending weighted end 110 and an upright, elongated, transparent tubular housing 111. A plurality of bar magnets 112 are disposed in similar polarity relationship within transparent tubular housing 111. A spacer bead 113 is positioned about axle 20 between assembly 108 and magnetic disc 105. In operation, when axle 20 rotates magnetic disc 105, as the similar polarity area of disc 105 approaches tubular housing 111, a repelling force is exerted on the nearest bar magnet 112 housed therein, which causes a chain reaction magnetic movement of each bar magnet 112 housed within tubular housing 111 to produce a visual effect of floating magnetic bars. As magnetic disc 105 continues to rotate, the offset periphery thereof moves away from tubular container 111 and the bar magnets 112 resume their original position therein. This action is continued as long as the supply of fluid medium 39 effects rotation of wheel 22 and rotatable axle 20. When the supply of fluid medium is exhausted in one of the triangular reservoirs, power unit 10 is rotated 180° to capture the fluid medium in the other triangular reservoir for further action. This rotation of power unit 10 causes assembly 108 to be maintained in the same position, due to the influence of weighted end 110, and tubular container housing 111 is again in position for the contained bar magnets to be influenced by rotation of off-center magnetic disc 105.

Figure 17:
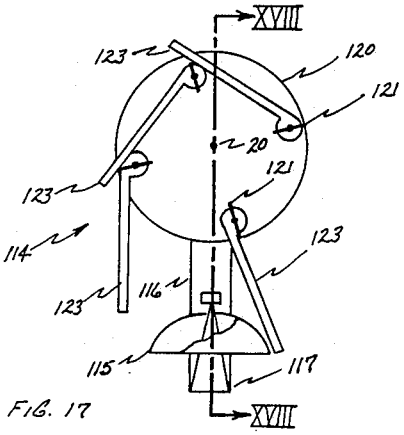
FIG. 17 is a schematic view of a bell or chime system employed with the regenerating power unit of FIG. 1.
Figure 18:
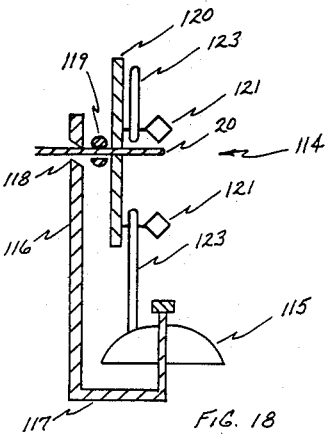
FIG. 18 is a sectional view taken along line XVIII—XVIII of FIG. 17.

Referring now to FIGS. 17 and 18 a sound producing educational and amusement accessory for power unit 10 is shown and generally designated by reference numeral 114. Accessory 114 includes a bell or chime 115 supported by a self-righting bracket 116 having a weighted end 117 thereon. Self-righting bracket 116 is slidably positioned on rotatable axle 20 via enlarged opening 118 therein. Enlarged opening 118 permits bracket 116 to rotate relative to rotating axle 20 and ensures that bell or chime 115 will always be disposed beneath axle 20 regardless of the orientation of power unit 10. A spacer bead 119 is slidably disposed on axle 20 adjacent weighted bracket 116 and a clapper assembly 120 is fixedly positioned on rotatable axle 20 adjacent to spacer bead 119. A plurality of clapper retainers 121 are disposed equidistant from each other about the periphery of clapper assembly 120. Each clapper retainer 121 has a portion thereof perpendicularly extending from the surface of clapper assembly 120. An elongated clapper element 123 is provided for each clapper retainer 121. Each elongated clapper element 123 has a free end and an end terminating in a circular loop surrounding, and freely rotatable on, the perpendicularly extending portion of one of the clapper retainers 121. As clapper assembly 120 rotates with rotatable axle 20, clapper elements 123 are sequentially released for free rotative fall when the clapper retainers 121 reach approximately the four o'clock position. Gravitational force causes the individual clappers 123 to sequentially rotate into striking contact with bell or chime 115 and produce an audible sound therewith as clapper assembly 120 is rotated by rotatable axle 20.

When the supply of fluid medium is exhausted from one reservoir, power unit 10 is rotated 180° to capture the fluid medium in the other reservoir and the power unit resumes operation. Rotation of power unit 10 also causes weighted bracket 116 to remain in the relative position shown in FIGS. 16 and 17 and bell 115 remains ready to be struck by the clapper elements 123.

Although the invention has been described relative to specific embodiments thereof, it is not so limited and there are numerous variations and modifications thereof that will be readily apparent to those skilled in the art in the light of the above teachings. For example, the illustrated embodiment of FIGS. 2, 5 and 6 show a portion of rotatable axle 20 extending from both front wall 17 and back wall 18. In this situation a different or identical educational and amusement accessory may be employed on each exposed end of rotatable axle 20. Also, one end of the axle 20 may be terminated inside of either or both front and back walls 17, 18 with no additional accessory or only one such accessory utilized. When axle 20 is terminated inside of one of the walls 17,18, the axle bearing assembly shown in FIG. 4 could be employed. Also, the transparent wall 18 permits visual observance of the power unit components in operation and can serve as an educational and amusement device without the use of accessories. Also, both front and back walls 17,18 may be formed of glass, transparent or reflective plastic or like material, when so desired. Although the specific embodiments described utilize granular fluid media such as small grain sand particles or specially prepared equal size microspheres, the invention is not so limited and any flowable fluid medium, including water and other liquids, is considered within the scope of the present invention.

Wheel 22 is not limited to the sixteen vane construction described and more, or fewer, vanes may be employed when so desired. The construction of wheel 22 may be by molding, when using plastic materials, or for the more exclusive "Executive" model of the present invention, wheel 22 may be precision cut from selected wood. Similarly, each of wall members 11, 12, 14, 15, 17 and 18, as well as diagonal supports 31,32, may be made from wood, extruded or molded plastic, with some or all of the walls being transparent or reflective, and some or all of the walls being opaque.

As described in the preferred embodiments, it is contemplated that flowable medium 39 will enter triangular chambers 29 at substantially the one o'clock position on wheel 22. If the weight of the flowable medium received in one chamber is not adequate to cause wheel 22 to incremently rotate, overflow of the medium will pass into the next lower adjacent chamber and proceed to fill that chamber until gravitational forces causes wheel rotation. Obviously, the invention is not restricted to this precise location and the rotation of wheel 22 could be effected with the initial medium flow being received at other than precisely at the one o'clock position. When employing precision microspheres as the flowable medium, the weight of the microspheres may be selected to speed up the rotative action of wheel 22. It is to be understood that the rotation of wheel 22 need not be constant but can be incremental as the chamber 29 receives adequate flowable medium to effect rotation. Also, the distance of rotation is not necessarily constant and the flowable medium begins to exit chamber 29 at essentially the four o'clock station with the chamber becoming completely empty at approximately the six o'clock station. The slotted opening and plate valve features of FIG. 8 are particularly well adapted for constant rotation of wheel 22 when so desired.

Other modifications include the use of a magnetic disc, for rotatable disc 93 employed in the embodiment of FIGS. 13–14, along with a similar polarity magnet for cam follow disc 94. In this same embodiment, rotatable disc 93 may be provided with multiple cam surfaces on the periphery thereof to increase the frequency of movement of cam follow disc 94 and thereby simulate more boat action.

It is also foreseen that, with the use of the support stand keeping the axle of the power unit relatively stationary during its reset operation, power unit 10 can be used as the coupled power supply for free standing motion machines, unlike the regenerating power-unit supported accessories described hereinabove.

These and other variations and modifications of the present invention will be readily apparent to those skilled in the art without departing from the spirit and scope of the appended claims.

Thus, the invention may practiced other than as specifically described.

What is claimed as new and desired to be secured by Letters Patent of the United States is:

1. A regenerating power unit comprising:

a box housing having a pair of end members, a pair of side members and a front and back member, said front and said back members being attached to and contained in spaced relationship with said pair of ends and said pair of sides, at least one of said front and said back members being formed of a transparent material, a rotatable axle member perpendicularly disposed relative to said front and said back members and having a length thereof extending through at least one of said front and said back members, a wheel having a hub portion rotatable therewith, said wheel being disposed between and adjacent said front and said back members, said wheel including a plurality of vanes tangently extending from said hub portion to a distance spaced from said hub portion, each of said plurality of vanes having a surface that terminates at a point on said hub and merges at said point with a surface of an adjacent vane, a circular wheel cover on each side of said wheel abutting said plurality of vanes and forming a plurality of elongated, open end, triangular, chambers therewith, at least one of said circular wheel covers on said wheel being formed of a transport material, a pair of elongated diagonal supports in contacting relationship with said front and said back members, said pair of elongated diagonal supports each having one end thereof fixedly connected to one of said side members and the other end thereof unattached and spaced from the opposite side member to thereby form a pair of open substantially triangular reservoirs on opposite sides of said wheel, a quantity of a flowable medium disposed within one of said triangular reservoirs, said flowable medium being selected from the group of flowable media consisting of a liquid, granular, finely divided sand particles, and equal sized microspheres, aperture means formed in each said diagonal support to permit flow of said flowable medium therethrough, said wheel being positioned relative to said aperture means such that any flow of said flowable medium therethrough will be received by at least one of said open end triangular chambers, means for selectively closing and adjustably opening said aperture means and to control the rate of flow of said flowable medium therethrough, whereby flow of said flowable medium passing through said aperture means into said at least one of said angular triangular chambers of said wheel causes rotation of said wheel due to gravitational force of the flowable medium received therein and, as said wheel rotates, the chambers receiving said flowable medium are emptied while other chambers are rotated into position to receive the flowable medium passing through said aperture, with this wheel rotation continuing until the supply of said flowable medium is exhausted from said triangular reservoir, whereupon said box housing is rotated 180° to capture the expended flowable medium in the other of said triangular reservoir whereby the subsequent flow of said flowable medium through the aperture therein causes said wheel to resume rotation.

2. The regenerating power unit of claim 1 wherein said means for selectively closing and adjustably opening said aperture means to control the rate of flowable medium therethrough comprises a needle valve for each said aperture means and, a rotatable control knob for each said needle valve extending, one each, through the respective sides of said box housing.

3. The regenerating power unit of claim 1 wherein said aperture means formed in said diagonal support comprises a slotted aperture and said means for selectively closing and adjustably opening said aperture to control the rate of flowable medium therethrough comprises a gate valve, said gate valve having a slotted opening therein and selectively and adjustably movable from a position wherein said slotted aperture is completely closed to a position wherein said slotted aperture is completely open.

4. The regenerating power unit of claim 1 including a support stand attached to said box housing, said support stand including a horizontal base portion, a pair of vertically extending triangular sides secured to said base portion, a pair of aligned transverse openings provided in the apex of said triangular sides for receiving opposite ends of said rotatable axle therethrough and serving to support said box housing in rotatable spaced relationship with said base portion of said support stand, detent means carried by said base portion permitting rotation of said box housing in a first direction and preventing rotation of said box housing in an opposite direction, a bracket attached to said base portion at one end thereof and disposed between said vertical sides of said support stand, said detent means having an L-shaped cross-sectional area, with the vertical or long portion of said L-shaped detent resting against and extending above the height of said bracket and the horizontal or short portion of said L-shaped detent being affixed to said base portion, said vertical portion of said detent being in contact with a side of said box housing when said box housing is disposed in a vertical mode and preventing said box housing from rotating in a first direction, said detent being contacted and flexed in a second direction by the same side on the opposite end of said box housing when said box housing is rotated in said second direction and returning to its original vertical position when the portion of said box housing causing said detent to flex is rotated out of contact therewith.

5. The regenerating power unit of claim 1 including a rotatable visual display assembly having an opening therein fixedly attached to said portion of said length of said rotatable axle extending through at least one of said front and said back members to cause rotation of said visual display as said axle rotates, said rotatable visual display assembly including a sound producing mechanism, said sound producing mechanism including, a rotatable clapper assembly, a plurality of clapper retainers disposed about the periphery of said clapper assembly, a clapper element supported by each said clapper retainer for freely rotating relative to aid clapper assembly, and a self-righting bell carried by said regenerating power unit in position to be struck by each said clapper element.

6. The regenerating power unit of claim 5 including said plurality of clapper retainers comprising at least four and each said clapper element supported by each said clapper retainer comprises an elongated rod element having a first end in freely rotatable attachment with one said clapper retainer and a second unattached end for striking said self-righting bell.

7. The regenerating power unit of claim 1 including a rotatable visual display assembly having an opening therein fixedly attached to said portion of said length of said rotatable axle extending through at least one of said front and said back members to cause rotation of said rotatable visual display assembly including a spoke hub fixed to and rotatable with said length of said rotatable axle extending through at least one of said front and said back members, a radial spoke having one end fixed to said spoke hub and having a miniature space shuttle vehicle fixed to the other end thereof, a self-righting cover positioned over said spoke hub to obscure said spoke hub and a portion of said radial spoke extending therefrom from view, said cover having an off-center opening therein and positioned on said axle to give the visual appearance of the shuttle vehicle orbiting the Earth in an elliptical orbit as said axle rotates.

8. The regenerating power unit of claim 1 including a rotatable visual display assembly having an opening therein fixedly attached to said portion of said length of said rotatable axle extending through at least one of said front and said back members to cause rotation of said visual display as said axle rotates, said rotatable visual display assembly including a spoke hub fixed to said portion of said length of said rotatable axle extending through one of said front and back members, at least one pair of spokes integral with and extending diametrically from said spoke hub, said spoke hub being fixedly attached to said rotatable axle for rotation therewith, an object secured to the respective ends of each of said diametrically opposed spokes for rotation therewith as said axle rotates.

9. The regenerating power unit of claim 8 wherein said rotatable visual display assembly comprises a miniature ferris wheel and each said object secured to the respective ends of each of said spokes is a self-righting simulated ferris wheel component.

10. The regenerating power unit of claim 8 wherein the said at least one pair of spokes is confined to a single pair of diametrically opposed spokes with an identical cow figurine secured to the end of each spoke, and further including a self-righting cover disposed on said rotatable axle, said self-righting cover serving to obscure from view the end of each said spoke member and the cow figurine secured thereto when the other of said cow figurines is above a horizontal plane taken along the axis of said axle, said self-righting cover including an enlarged grommet therein for receiving and permitting substantially unimpeded rotation of said axle therethrough, and weight means disposed in said self-righting cover to thereby position and maintain said self-righting cover in substantially stationary position as said axle rotates, said self-righting cover having a first portion carrying said weight means and designed to simulate a group of clouds and a second portion designed to simulate the moon and maintained vertically above said rotating axle while said self-righting cover remains stationary on said rotating axle and, wherein rotation of said spokes causes said simulated cow figurines to give the appearance of jumping over the moon.

11. The regenerating power unit of claim 1 including:

a magnetic disc having an off-center opening therein attached to said axle for rotation therewith, a self-righting transparent tube carried by said rotatable axle and disposed adjacent said magnetic disc, a plurality of bar magnets disposed in similar polarity relationship and contained within one end of said transparent tube and a weight carried by the other end of said transparent tube, whereby as said axle is rotated, said magnetic disc will undergo off-center rotation with part of the rotating disc passing adjacent one of said plurality of bar magnets contained within said transparent tube one each revolution to influence repelling movement of the end bar magnet contained therein which, in turn, causes a chain reaction magnetic movement in each bar magnet disposed within said transparent tube to produce a visual effect of floating metal bars within the transparent tube.

12. The self generating power unit of claim 1 including:

a disc having an off-center opening therein attached to said axle for rotation therewith and serving as a cam, a cam follower disposed in abutting relationship to said disc so as to be influenced by and movable by rotation of said disc, a simulated boat having one end thereof attached to and movable with said cam follower, said simulated boat having the other end thereof pivotally connected to a simulated body of water, said simulated body of water being positioned on said power unit and maintained adjacent the bottom of said simulated boat at all times, whereby rotation of said wheel and its integral axle causes said disc to rotate and effect movement of said cam follower in a vertical up and down direction as said disc rotates tot hereby cause pivotally movement of the end of the simulated boat to undergo a repeating rocking motion and give the appearance of an actual boat sailing on a body of water.

13. A regenerating power unit comprising:

a box housing having a pair of end members, a pair of side members and a front and back member, as least one of aid front and said back members being formed of a transparent material, a rotatable axle member perpendicularly disposed relative to said front and said back members and having a length thereof extending through at least one of said front and said back members, a hub fixed to said axle and rotatable therewith, a wheel integral with and rotatable with said hub, said hub and said wheel being disposed between and adjacent said front and said back members, said wheel including a plurality of vanes spaced from each other and extending tangently from said hub, to a distance spaced from said hub, each of said plurality of vanes having a surface that terminates at a point on said hub and merges with a surface of an adjacent vane at said point, a circular wheel cover on each side of said wheel and abutting said vanes such that an elongated, open ended triangular chamber is formed between each two adjacent vanes on said wheel, at least one of said circular wheel covers on said wheel being formed of a transparent material, a quantity of a flowable medium disposed within one of said reservoirs, aperture means formed in each said reservoir to permit flow of said flowable medium therethrough, said wheel being positioned relative to said aperture means such that any flow of said flowable medium therethrough will be received between at least two of said plurality of vanes, and wherein one of said open ended triangular chambers is always facing upward or substantially perpendicular to a horizontal plane taken along the axis of said axle at essentially the one o'clock position of said wheel and one wheel chamber is always perpendicularly disposed relative to a horizontal plane taken along the axis of said axle and facing downward at substantially the seven o'clock position of said wheel, whereby flow of said flowable medium received between said vanes causes gravitational rotation of said wheel and, as said wheel rotates, the vanes receiving said flowable medium are emptied while other vanes are rotated into position to receive the flowable medium until the supply of said flowable medium is exhausted from said reservoir, whereupon said box housing is rotated 180° to capture the expended flowable medium in the other of said reservoirs whereby subsequent flow of said flowable medium through the aperture therein causes said wheel to resume rotation.

14. The regenerating power unit of claim 13 including:

said front and said back members being attached to said pair of ends and said pair of sides, said rotatable axle being slidably adjustable through said wheel to permit a selective extension or reduction of the length of said axle portion extending from a selected one of said front and back members, and a rotatable visual display assembly secured to and rotatable with the said length of said rotatable axle member extending through said at least one of said front and said back members.

* * * * *